US005371341A

United States Patent [19]

Ota et al.

[11] Patent Number: 5,371,341

[45] Date of Patent: Dec. 6, 1994

[54] LINEAR HEATER

[75] Inventors: Shigeo Ota; Shingo Ooyama, both of Kyoto, Japan

[73] Assignee: Rohm Co., Ltd., Kyoto, Japan

[21] Appl. No.: 35,217

[22] Filed: Mar. 22, 1993

[30] Foreign Application Priority Data

Mar. 26, 1992 [JP] Japan ..... 4-68823

[51] Int. Cl.[5] ..... H05B 3/16

[52] U.S. Cl. ..... 219/543

[58] Field of Search ..... 219/543, 216, 544; 338/306, 308, 309, 294; 346/76 PH; 355/285; 437/195; 392/434, 438, 439

[56] References Cited

U.S. PATENT DOCUMENTS

| | | | |
|---|---|---|---|
| 3,496,336 | 2/1970 | Hingorany et al. | 219/544 |
| 3,515,850 | 6/1970 | Cady, Jr. | 346/76 PH |
| 3,645,783 | 2/1972 | Rupert et al. | 338/308 |
| 3,852,563 | 12/1974 | Bohorquez et al. | 219/543 |
| 3,876,912 | 4/1975 | Sanders | 338/309 |
| 3,909,680 | 9/1975 | Tsunashima | 338/309 |
| 4,038,517 | 7/1977 | Nelson | 219/543 |
| 4,073,970 | 2/1978 | Allen | 219/543 |
| 4,099,046 | 7/1978 | Boynton et al. | 219/543 |
| 4,110,598 | 8/1978 | Small | 219/543 |
| 4,709,243 | 11/1987 | Kato et al. | 346/76 PH |
| 4,792,781 | 12/1988 | Takahashi et al. | 338/308 |
| 5,055,859 | 10/1991 | Wakabayashi et al. | 346/76 PH |
| 5,068,517 | 11/1991 | Tsuyuki et al. | 219/543 |
| 5,236,870 | 8/1993 | Sakata et al. | 437/195 |
| 5,288,973 | 2/1994 | Ota et al. | 219/216 |
| 5,304,784 | 4/1994 | Tagashira et al. | 219/543 |
| 5,306,898 | 4/1994 | Yukawa et al. | 219/543 |

FOREIGN PATENT DOCUMENTS

| | | | |
|---|---|---|---|
| 58-114977 | 7/1983 | Japan | 346/76 PH |
| 61-76378 | 4/1986 | Japan | 346/76 PH |
| 61-244565 | 10/1986 | Japan | 346/76 PH |
| 61-272169 | 12/1986 | Japan | 346/76 PH |
| 62-48568 | 3/1987 | Japan | 346/76 PH |
| 63-144057 | 6/1988 | Japan | 346/76 PH |

*Primary Examiner*—Geoffrey S. Evans
*Attorney, Agent, or Firm*—William H. Eilberg

[57] ABSTRACT

A linear heater comprises an insulating substrate, at least one resistor strip formed on the substrate, insulating edge members formed on the substrate to extend along the respective longitudinal margins of the resistor strip in contact therewith, and a heat-resistant protective coating formed on the substrate for covering the resistor strip and the respective edge members. The respective edge members, which themselves provide an insulating function, compensate for a thickness reduction of the protective coating at positions corresponding to the longitudinal margins of the resistor strip.

7 Claims, 4 Drawing Sheets

LINEAR HEATER

BACKGROUND OF THE INVENTION

1. Field of the Invention

This invention relates generally to heaters. More specifically, the present invention relates to a linear heater which can be advantageously used in an office automation apparatus such as a photocopier or electrophotographic printer for fixing images on a paper sheet for example.

2. Description of the Prior Art

Various types of linear heaters are known for fixing images (deposited toner) on a paper sheet in photocopiers or electrophotographic printers (e.g. laser beam printer). Typical examples include a lamp heater and a roller heater.

However, the lamp heater and roller heater are equally disadvantageous in that there is a limitation in reducing size (thickness) and cost. Further, the lamp heater is easily damaged due to the nature of material, whereas the roller heater has a complicated structure due to the necessity of incorporating plural heating elements within the roller.

To eliminate the problems of the conventional heaters, it has been proposed to use a linear heater for fixing images on a paper sheet in electrophotography, as disclosed for example in U.S. Pat. No. 5,068,517. For the convenience of explanation, a typical arrangement of a prior art linear heater is shown in FIGS. 7 and 8 of the accompanying drawings.

As shown in FIGS. 7 and 8, the typical prior art linear heater comprises an elongate ceramic insulating substrate A1 formed with a printed resistor strip A2 extending longitudinally of the substrate. Each end of the resistor strip A2 is provided with a conductor terminal pads A3 made of e.g. silver for connection to a power source (not shown). The resistor strip A2 is covered by a heat-resistant protective coating A4 for providing electrical insulation in addition to insuring smooth contact with a sheet material to be heated. The resistor strip A2, which is made of silver-palladium alloy for example, generates heat when a current is passed therethrough.

Obviously, the prior art linear heater is very simple in arrangement. Further, the linear heater can be made very thin and light by reducing the thickness of the substrate A1. Moreover, the linear heater is also advantageous in that the time required for warming up is very short. However, the prior art linear heater still has the following problem.

The protective coating A4 is formed by depositing a paste material over the resistor strip A2 and thereafter allowing the paste to harden by drying. Due to the viscous nature of the paste, it tends to flow down toward the substrate A1 along the respective longitudinal margins A2' of the resistor strip A2 before complete hardening, as shown in FIG. 8. As a result, the hardened protective coating A4 will have a larger thickness T1 immediately above the resistor strip A2 but a smaller thickness T2 at positions corresponding to the longitudinal margins A2' of the resistor strip A2.

Obviously, if the thickness T2 of the protective coating A4 at the longitudinal margins A2' of the resistor strip A2 is too small, the protective coating A4 fails to provide intended insulation at these positions. Thus, to be safer, the protective coating A4 as a whole must be rendered thick enough. However, such a solution gives rise to another problem that the increased thickness T1 of the protective coating A4 immediately above the resistor strip A2 hinders thermal transmission from the resistor strip A2, consequently failing to provide an intended heating function.

SUMMARY OF THE INVENTION

It is, therefore, an object of the present invention to provide a linear heater wherein a protective coating provides an intended electrical insulation without unduly increasing its thickness as a whole.

According to the present invention, there is provided a linear heater comprising: an insulating substrate; at least one resistor strip formed on the substrate, the resistor strip having longitudinal margins; insulating edge members formed on the substrate to extend along the respective longitudinal margins of the resistor strip in contact therewith; and a heat-resistant protective coating formed on the substrate for covering the resistor strip and the respective edge members.

Before hardening, a paste material for forming the protective coating flows down toward the substrate along the surfaces of the respective edge members but not directly along the surfaces of the longitudinal margins of the resistor strip. Therefore, even if the protective coating becomes locally thin at positions corresponding to the longitudinal margins of the resistor strip, sufficient insulation is still provided by the edge members which themselves have an insulating function. As a result, the protective coating as a whole need not be rendered unduly thick, thereby preventing an unacceptable reduction of heat transmission from the resistor strip through the protective coating.

Preferably, the respective edge members are substantially equal in thickness to the resistor strip. Such an arrangement provides surface flatness and smoothness on top of the resistor strip.

The linear heater according to present invention may comprise a plurality of resistor strips arranged in parallel to each other on the substrate. In this case, each of the resistor strips is flanked longitudinally by insulating edge members. Further, the protective coating may be provided separately for each of the resistor strips, or commonly for all of the resistor strips. If necessary, respective one of the edge members located between each two adjacent resistor strips may be made to entirely fill a clearance between the two adjacent resistor strips.

Other objects, features and advantages of the present invention will become apparent from the following detailed description of the preferred embodiments given with reference to the accompanying drawings.

DETAILED DESCRIPTION OF THE PREFERRED EMBODIMENTS

Figure 1:
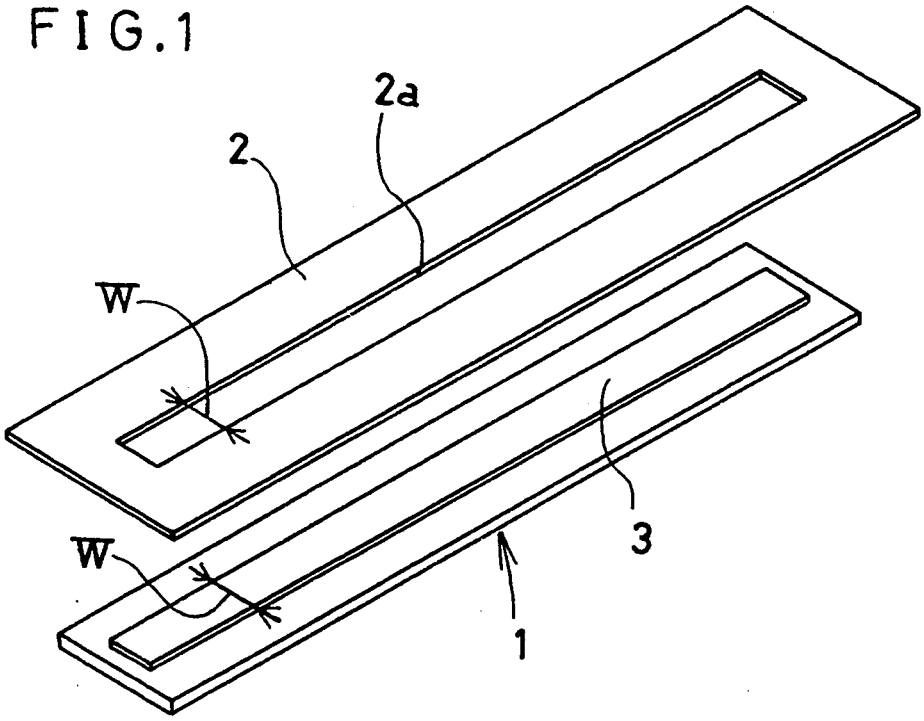
FIG. 1 is a perspective view showing a resistor forming step for making a linear heater according to the present invention.
Figure 2:
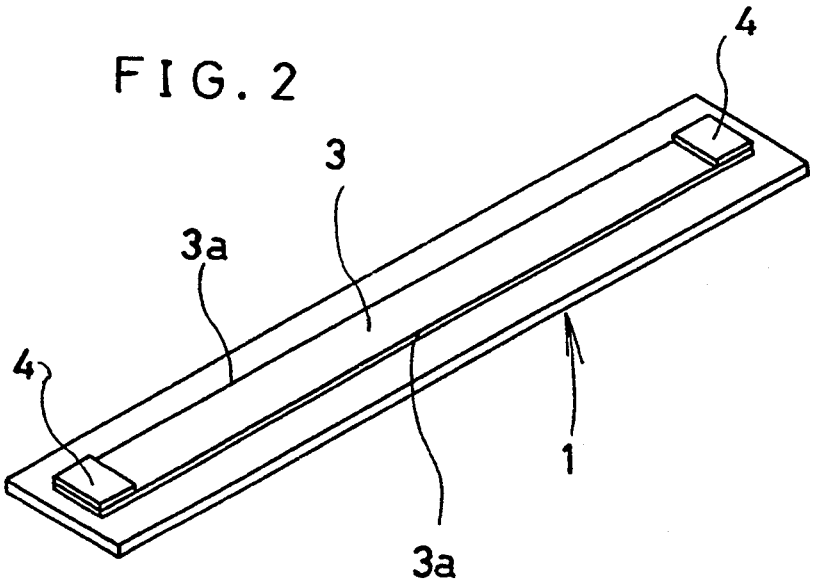
FIG. 2 is a perspective view showing a pad forming step for making the same heater.
Figure 3:
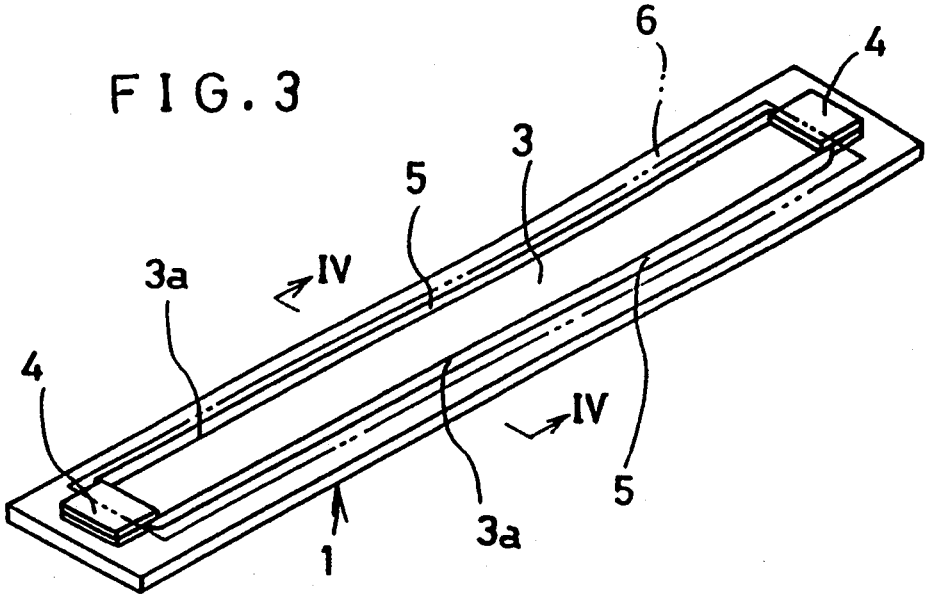
FIG. 3 is a perspective view showing the same heater as a final product.
Figure 4:
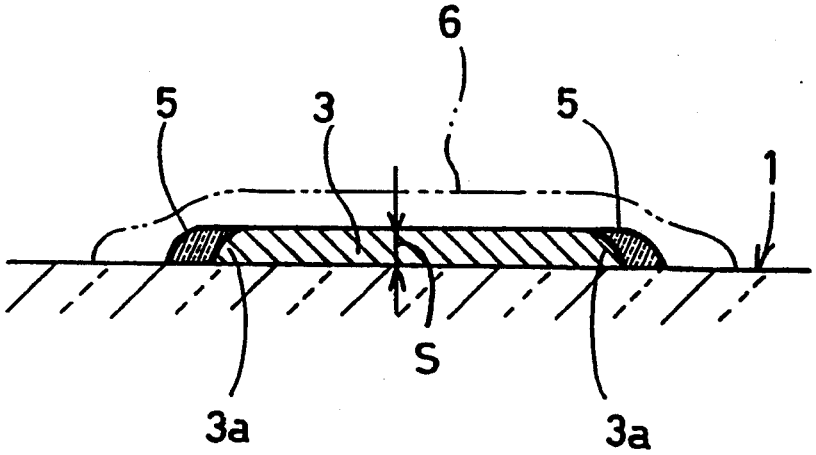
FIG. 4 is a sectional view taken along lines IV—IV in FIG. 3.

FIGS. 1 through 3 of the accompanying drawings show the successive steps of making a linear heater according to a first embodiment of the present invention, whereas FIG. 4 shows the same heater as a final product.

For making the linear heater, a resistor strip 3 having a width W and a thickness S (see FIG. 4) is first formed on an elongate insulating substrate 1 by a screen printing method for example, as shown in FIG. 1. For this purpose, use is made of a stencil 2 having a window slit 2*a* whose width is equal to that of the resistor strip 3. The substrate 1 may be made of a heat-resistant insulating material such as ceramic (e.g. alumina). The resistor strip 3 may be made by depositing a paste of silver-palladium (Ag—Pd) or ruthenium oxide and thereafter baking the paste for fixation.

Then, as shown in FIG. 2, a pair of conductor terminal pads 4 are formed on the resistor strip 3 at both ends thereof. The terminal pads 4 may be made of metal such as copper, silver or gold.

Then, as shown in FIG. 3, a pair of insulating edge members 5 having a predetermined width are formed continuously along both longitudinal margins 3*a* of the resistor strips 3 in contact therewith. The edge members 5 may be made of a heat-resistant insulating material such as glass. Preferably, the thickness of the edge members 5 is substantially equal to that of the resistor strip 3 (see FIG. 4).

Finally, as also shown in FIG. 3, a protective coating 6 is formed on the substrate 1 again by a screen printing method for example for covering the resistor strip 3 and the respective insulating edge members 5. The protective coating 6 may be made of a heat-resistant insulating material such as glass (initially in a pasty condition).

Before hardening, the protective coating 6 has a tendency to become thinner at positions corresponding to the respective edge members 5 because the pasty material for the protective coating 6 flows down toward the substrate 1 along the edge members 5. However, since the edge members 5 themselves have an insulating function, the protective coating 6 can be considered to have an additional thickness provided by the edge members 5 at the positions corresponding to the longitudinal margins 3*a* of the resistor strip 3. Thus, the thickness of the protective coating 6 as a whole need not be increased, consequently insuring intended heat transmission from the resistor strip 3.

Figure 5:
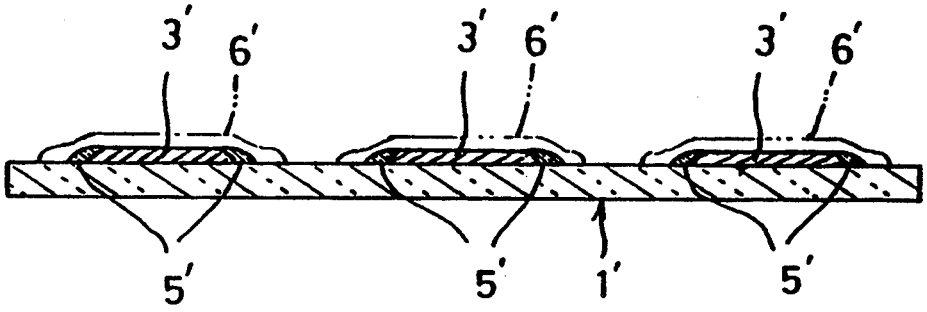
FIG. 5 is a view, in transverse section, showing another linear heater according to the present invention.

FIG. 5 shows a linear heater according to a second embodiment of the present invention. The heater of this embodiment comprises an elongate insulating substrate 1′ which is increased in width for carrying a plurality (e.g. three) of resistor strips 3′ in parallel to each other.

Similarly to the first embodiment, each of the resistor strips 3′ in the second embodiment is flanked longitudinally by a pair of insulating edge members 5′. The resistor strip 3′ together with the associated pair of edge members 5′ is covered by a protective coating 6′. Of course, the resistor strip is formed, at both ends, with respective conductor terminal pads (not shown).

Figure 6:
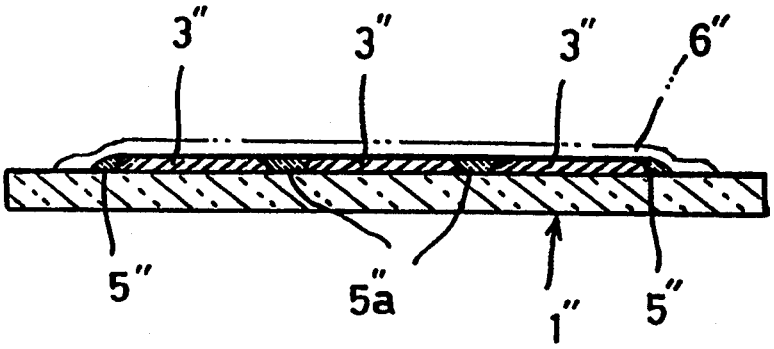
FIG. 6 is a view, in transverse section, showing a further linear heater according to the present invention.
Figure 7:
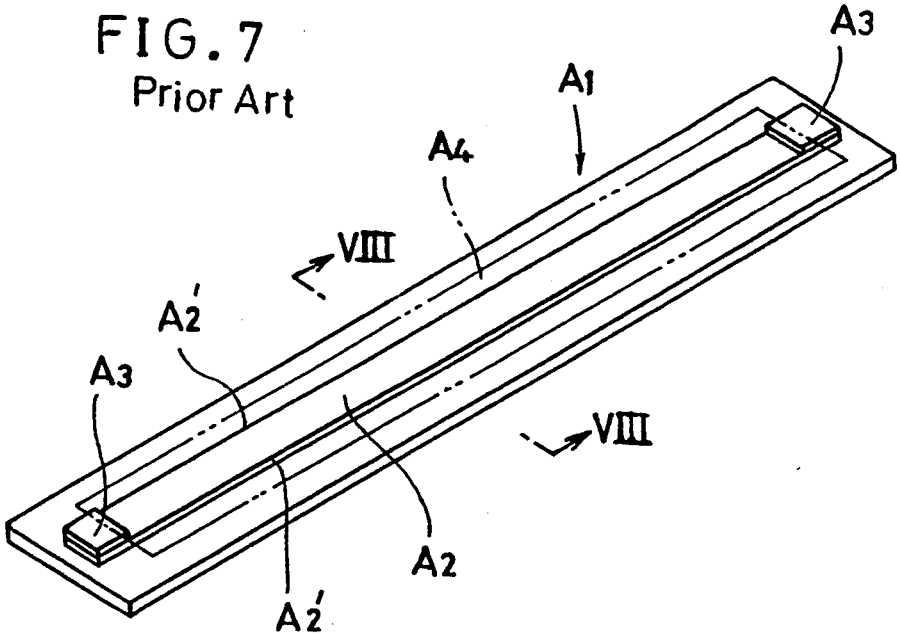
FIG. 7 Prior Art
FIG. 7 is a perspective view showing a prior art linear heater.
Figure 8:
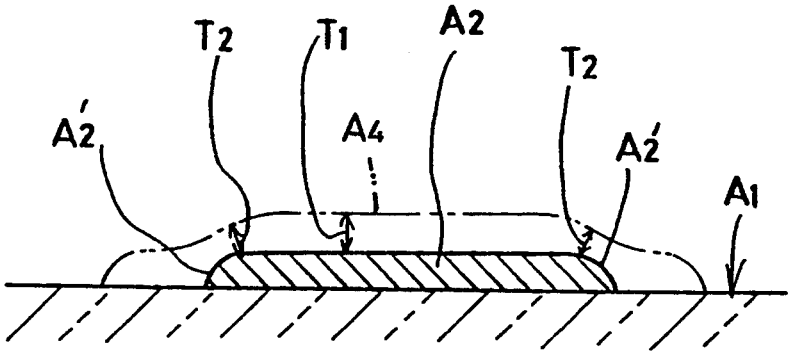
FIG. 8 Prior Art
FIG. 8 is a sectional view taken along lines VIII—VIII in FIG. 7.

FIG. 6 shows a linear heater according to a third embodiment of the present invention. Similarly to the second embodiment, the heater of the third embodiment comprises an elongate insulating substrate 1″ which carries a plurality (e.g. three) of resistor strips 3″ in parallel to each other. However, the respective resistor strips 3″ are held relatively close to each other.

In the third embodiment, each of the resistor strips 3″ is flanked longitudinally by a pair of insulating edge members 5″, 5*a*″. Those edge members 5*a*″ located between the respective resistor strips 3″ fill the clearances between these strips. As a result, all of the resistor strips 3″ together with all of the respective edge members 5″ are covered by a common protective coating 6″ which has a surface flatness over a wide area of the substrate 1″.

The present invention being thus described, it is obvious that the same may be varied in many ways. For instance, the linear heater according to the present invention may be also used for heat-sealing a thermoplastic sheet in addition to image fixation. Such variations are not to be regarded as a departure from the spirit and scope of the invention, and all such modifications as would be obvious to those skilled in the art are intended to be included within the scope of the following claims.

We claim:

1. A linear heater comprising:

an insulating substrate;

at least one resistor strip formed on the substrate, the resistor strip having longitudinal margins and being narrower than the substrate;

insulating edge members separated from each other by the resistor strip and formed on the substrate to extend along the respective longitudinal margins of the resistor strip in contact therewith, each of the edge members being narrower than the resistor strip; and a heat-resistant protective coating formed on the substrate for entirely covering the resistor strip and the respective edge members, the protective coating being in direct contact with the resistor strip except where the respective edge members are in contact with the resistor strip;

wherein a combination of the resistor strip and edge members is narrower than the substrate.

2. The linear heater according to claim 1, wherein the respective edge members are substantially equal in thickness to the resistor strip.

3. The linear heater according to claim 1, wherein the respective edge members are made of glass.

4. The linear heater according to claim 1, which comprises a plurality of resistor strips arranged in parallel to each other on the substrate, the respective edge members are provided for each of the resistor strips.

5. The linear heater according to claim 4, wherein the protective coating is provided separately for each of the resistor strips together with its associated edge members.

6. The linear heater according to claim 4, wherein the protective coating is provided commonly for all of the resistor strips together with their associated edge members.

7. The linear heater according to claim 6, wherein respective one of the edge members located between each two adjacent resistor strips entirely fills a clearance between said each two adjacent resistor strips.

* * * * *